United States Patent [19]

Hobday

[11] 4,220,322

[45] Sep. 2, 1980

[54] ONE-HAND OPERATED, RATCHET-ACTUATED, QUICK-SET C-CLAMP

[76] Inventor: Harold W. Hobday, 10530 Arno Rd., Galt, Calif. 95632

[21] Appl. No.: 10,463

[22] Filed: Feb. 8, 1979

[51] Int. Cl.[3] ..... B25B 5/02

[52] U.S. Cl. ..... 269/6; 269/214

[58] Field of Search ..... 269/6, 212–215, 269/216, 143, 249; 254/108–111, 68–72

[56] References Cited

U.S. PATENT DOCUMENTS

| | | | |
|---|---|---|---|
| 2,323,654 | 7/1943 | Gordy et al. | 269/214 |
| 2,768,768 | 10/1956 | Cornell et al. | 254/110 |
| 3,492,854 | 2/1970 | Eppler | 254/106 |
| 4,032,109 | 6/1977 | Wilson | 254/69 |

*Primary Examiner*—Robert C. Watson

*Attorney, Agent, or Firm*—Roger B. Webster

[57] ABSTRACT

A C-clamp arranged for operation by one hand, from a depending hand grip unit, to cause actuation of a ratchet assembly which quick-sets or closes the C-clamp on a work piece; the arrangement permitting of ready manual release of the C-clamp from the work piece.

8 Claims, 4 Drawing Figures

ONE-HAND OPERATED, RATCHET-ACTUATED, QUICK-SET C-CLAMP

BACKGROUND OF THE INVENTION

1. Field of the Invention

The present invention relates to hand tools and in particular to a C-clamp and which conventionally requires a threaded stem to be manually, and somewhat tediously, rotated to effect adjustment of the movable work-engaging pad of the tool. Heretofore, some C-clamps have been developed which are of a type in which adjustment of the movable work-engaging pad is attained by means other than a threaded stem. However, such prior adaptations or modifications have not met with any substantial success, and due to complexity and cost of manufacturing, inefficient or impractical structural and functional facturing, inefficient or impractical structural and functional arrangements, or lack of ease and convenience of adjustment when in use. The present invention was conceived, and reduced to practice, by me in a successful effort to provide a C-clamp of such type and yet one which overcomes such objections.

2. The Prior Art

U.S. Pat. Nos. 286,688; 2,472,658; 2,504,373; 2,612,808; 2,688,351; 2,920,665 and 3,427,016 represent the most relevant prior art known to applicant.

SUMMARY OF THE INVENTION

The present invention is directed to, and it is a major object to provide, a C-clamp arranged for operation by one hand, from a depending hand grip unit, to cause actuation of a ratchet assembly which quick-sets or closes the C-clamp on a work piece; the arrangement permitting of ready manual release of the C-clamp from the work piece.

The present invention provides, as another important object, a C-clamp as above, which is simple in structure and hence capable of manufacture with facility and economy, and a C-clamp which is easy to manipulate in use while providing a very close or tight grip on the work piece.

The present invention provides, as a still further object, a practical and reliable C-clamp of the type described which is exceedingly effective for the purpose and for which it is designed.

DESCRIPTION OF THE PREFERRED EMBODIMENT

Figure 1:
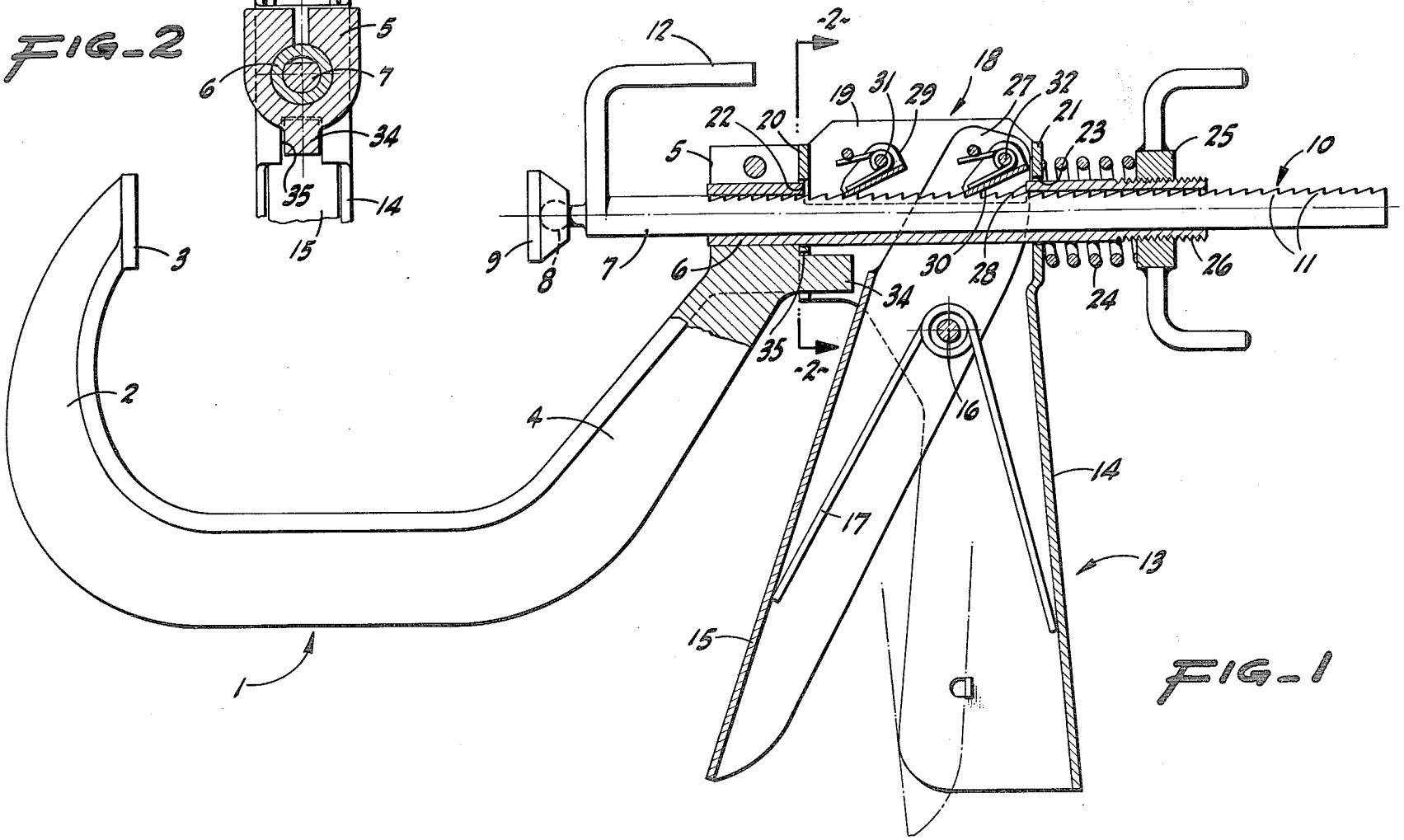
FIG. 1 is a side elevation of the present C-clamp in open position; the view being partly in section.
Figure 2:
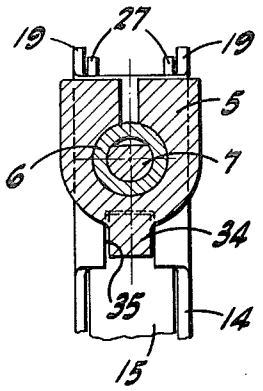
FIG. 2 is a fragmentary cross section taken substantially on line 2—2 of FIG. 1.
Figures 3, 4:
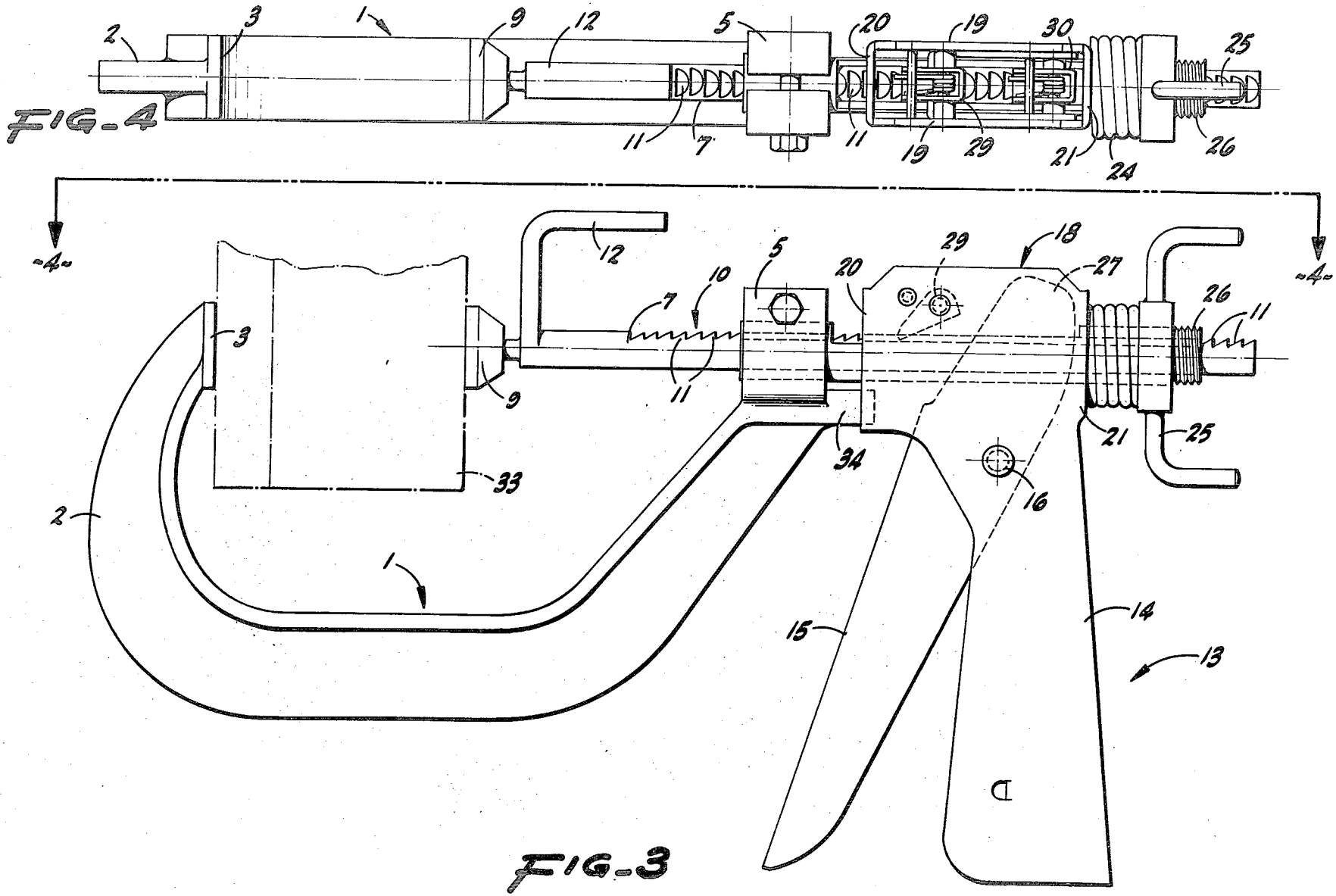
FIG. 3 is a side elevation of the present C-clamp as in use and engaging a work piece.
FIG. 4 is a plan view taken substantially on line 4—4 of FIG. 3.

Referring now more particularly to the drawings and to the characters of reference marked thereon, the present C-clamp comprises a normally upwardly opening, C-shaped body 1 provided at the upper end of its outer leg 2 with a fixed, rearwardly facing, work-engaging pad 3. At the upper end thereof, the inner leg 4 of body 1 includes an integral, split collar 5 co-axial with the longitudinal working axis of the tool; the forward end of a longitudinal tube 6 being engaged in collar 5 and clamped therein by a cross bolt as shown.

The tube 6 is of a length to extend some distance rearwardly from the collar 5, and a rod-like stem 7 (circular in cross section) is slidably engaged—with a close running fit—in the tube; the stem 7 projecting both forwardly and rearwardly out of the tube 6. At its exposed front end, the stem 7 is swivelly fitted, by means of a ball and socket unit 8, with a forwardly facing, work-engaging pad 9. The pad 9, which is the adjustable one as will later appear, is alined with the fixed work-engaging pad 3.

The stem 7 is formed, on the top thereof, with a longitudinal row 10 of rearwardly facing ratchet teeth 11; such row of teeth extending from the rear end of stem 7 to a point adjacent but short of the front end thereof.

At its front end (i.e., immediately back of the ball and socket unit 8 and work-engaging pad 9 thereon), the stem is fitted with a laterally projecting, inverted L-shaped, finger-engageable handle 12; the purpose of handle 12 being to permit of part-circle rotation thereby of the stem 7 and for the purpose later described.

Rearwardly of the C-shaped body 1, there is a depending hand grip unit, indicated generally at 13; such unit including a hand grip 14 and a hand lever 15 forwardly thereof; the hand lever 15 being transversely pivoted adjacent but short of its upper end on the hand grip, as at 16, whereby the user—grasping the hand grip unit 13 and squeezing thereon—causes hand lever 15 to swing toward said hand grip 14, and against a yieldable, legged spring 17 which normally holds grip 14 and lever 15 in expanded or inverted "V" spaced-apart relation.

The upper portion of the hand grip 14 (which is actually of channel shape as shown) is formed with an integral, box-like carrier indicated generally at 18. Such carrier includes transversely spaced side walls 19, a front end wall 20, and a rear end wall 21. The end walls 20 and 21 have alined circular holes 22-23 therein; the tube 6 projecting in slidable, matching relation through such holes, and hence through the carrier 18 intermediate the ends of said tube 6. The carrier 18 (i.e., the front wall 20 thereof) initially abuts against the rear end of the clamping collar 5, but can shift rearwardly therefrom a certain distance as will later appear.

A short, stiff, normally substantially unloaded, helical compression spring 24 surrounds the tube 6 between the rear end wall 21 of carrier 18 and a wing nut 25 rotatably and adjustably threaded on a rear portion 26 of tube 6; the wing nut thus occupying a position above, and to the rear of, the hand grip unit 13.

The hand lever 15, of hand grip unit 13, embodies—at its upper end—transversely spaced, upstanding side plates 27 disposed within the confines of carrier 18 and lying close to the corresponding side walls 19 of the latter.

The upper portion of the tube 6 is provided—essentially in the zone of carrier 18—with an elongated top-slot 28 whose purpose is to permit of access to, and engagement with, the row 10 of ratchet teeth 11 by a spring-urged, holding pawl 29 pivoted in position between the side walls 19 of carrier 18 and a spring-urged, stem-advancing pawl 30 disposed to the rear of pawl 29 and pivoted in position between the side plates 27. The pawls 29 and 30 are supported by pins 31 and 32, respectively, which extend transversely as shown.

To engage a work piece 33 in the clamp (i.e., between pads 3 and 9), the user grasps the hand grip unit 13 and successively alternately squeezes and releases it—whereby with each squeeze the hand lever 15 is swung toward hand grip 14, and which results in the advancing pawl 30 forwardly thrusting against one of the ratchet teeth 11, and which moves the stem 7 forwardly a corresponding distance. After each squeeze and release of the hand grip unit 13, the advancing pawl 30 ratchets rearwardly and then re-engages with another of said ratchet teeth 11; the holding pawl 29-which overruns as the stem is advanced—engaging a ratchet tooth 11 and holding the stem against retraction during the time that the advancing pawl 30 ratchets rearwardly to a new position of tooth engagement.

Thus, the stem 7 is progressively advanced and until the work piece 33 is initially engaged between the pads 3 and 9 and resistance is encountered. Thereafter, and to assure of a positive grip on the work piece, the hand grip unit 13 is further worked (squeezed and released until the last possible ratchet tooth 11 is engaged by the advancing pawl 30), and which results in the carrier 18 being backed away—on the tube 6—a short distance from the collar 5, and which movement of the carrier compresses the short spring 24. This imposes on the stem 7 an extremely forceful forward and unyielding force, and which produces a most effective and positive clamping action on the work piece. If necessary in any instance, the wing nut 25 may be manually tightened in the completion of the clamping operation.

In order to release the clamp, the wing nut 25 is loosened and thereafter the stem 7 is part-circle rotated in the tube 6 by means of the handle 12; such rotation causing the pawls 29-30 to escape the engaged ratchet teeth 11, whereby the stem 7 is then free to slide rearwardly or forwardly in said tube 6 and to a new position to engage a work piece of larger or smaller size, respectively.

To prepare the clamp for a subsequent use, and after release of the parts as above, the stem 7 is manually, longitudinally shifted as necessary, and then the wing nut 25 is tightened (or loosened as the case may be) until the spring 24 is engaged—unloaded—between the rear end wall 21 of the carrier 18 and said wing nut. The clamp is now ready for another clamping operation.

In order to prevent the hand grip unit 13 from undesirably rotating about the tube 6, the inner leg of the body 1 includes, at its upper end portion, an integral, rearwardly projecting, locator tongue 34 which slidably extends through a notch 35 in the fore part of carrier 18 below the tube; said tongue being of a length to remain in said notch in all normal longitudinal working positions of the carrier.

From the foregoing description, it will be readily seen that there has been produced such a C-clamp of the type described as substantially fulfills the objects of the invention as set forth herein.

While this specification sets forth in detail the present and preferred construction of the C-clamp of the type described, still in practice such deviations from such detail may be resorted to as do not form a departure from the spirit of the invention as defined by the appended claims.

I claim:

1. An improved C-clamp comprising a C-shaped body having an outer leg and an inner leg, a tube secured to the free end of the inner leg and extending rearwardly therefrom, a stem slidably engaged in the tube and projecting from the front end thereof, alined work-engaging pads on the exposed front end of the stem and the outer leg of the body, a hand grip unit mounted in connection with and depending from the tube rearwardly of the body, the hand grip unit including a hand grip and a movable hand lever pivotally associated therewith, the hand lever being movable by one-hand squeezing of the hand grip unit, and means between the hand grip unit and the stem operative to step-by-step advance the stem in the tube upon recurrent manual squeezing of the hand grip unit and resultant movement of the hand lever, and means to releasably hold the stem in each advanced position thereof; the stem-advancing means including a pawl and ratchet mechanism, and the tube being formed with a longitudinal slot in the working zone of the pawl and ratchet mechanism; the stem having a row of ratchet teeth thereon normally in register with and exposed through the slot, and the pawl and ratchet mechanism including an advancing pawl extending through the slot and progressively engaging the teeth of said row thereof.

2. An improved C-clamp, as in claim 1, in which the stem is manually rotatable in the stem to release the pawl and ratchet mechanism, including said advancing pawl, from the stem.

3. An improved C-clamp comprising a C-shaped body having an outer leg and an inner leg, a tube secured to the free end of the inner leg and extending rearwardly therefrom, a stem slidably engaged in the tube and projecting from the front end thereof, alined work-engaging pads on the exposed front end of the stem and the outer leg of the body, a hand grip unit mounted in connection with and depending from the tube rearwardly of the body, the hand grip unit including a hand grip and a movable hand lever pivotally associated therewith, the hand lever being movable by one-hand squeezing of the hand grip unit, and means between the hand grip unit and the stem operative to step-by-step advance the stem in the tube upon recurrent manual squeezing of the hand grip unit and resultant movement of the hand lever, and means to releasably hold the stem in each advanced position thereof; the tube being formed with a longitudinal slot in the working zone of the stem-advancing means, the stem-advancing means and stem-holding means being included in a pawl and ratchet mechanism having an advancing pawl and a holding pawl, respectively, extending through the slot in the tube, the stem having a row of ratchet teeth thereon normally in register with and exposed through the slot; the advancing pawl and holding pawl progressively and alternately engaging the teeth of said row thereof, and the stem being manually rotatable to release said pawls from the ratchet teeth.

4. An improved C-clamp comprising a C-shaped body having an outer leg and an inner leg, a tube secured to the free end of the inner leg and extending rearwardly therefrom, a stem slidably engaged in the tube and projecting from the front end thereof, alined work-engaging pads on the exposed front end of the stem and the outer leg of the body, a hand grip unit mounted in connection with and depending from the tube rearwardly of the body, the hand grip unit including a hand grip and a movable hand lever pivotally associated therewith, the hand lever being movable by one-hand squeezing of the hand grip unit, and means between the hand grip unit and the stem operative to step-by-step advance the stem in the tube upon recurrent manual squeezing of the hand grip unit and resultant movement of the hand lever, and means to releasably hold the stem in each advanced position thereof; the hand grip being formed at its upper end with a carrier through which the tube extends, the hand lever being pivoted intermediate its ends on the hand grip below the carrier and including an upper portion projecting into the carrier, the tube being formed with a longitudinal slot in the working zone of the stem-advancing means, the stem-advancing means and stem-holding means being included in a ratchet mechanism having, within the carrier, an advancing pawl and a holding pawl, respectively, the stem having thereon a row of ratchet teeth normally exposed through the slot and to the interior of the carrier, the advancing pawl being mounted in connection with the upper portion of the hand lever and the holding pawl being mounted in connection with the carrier, the pawls extending through the slot and normally engaging ratchet teeth of said row, and the stem being manually rotatable in the tube to release both of said pawls from the ratchet teeth.

5. An improved C-clamp, as in claim 4, in which the carrier is slidable on the tube, a nut adjustably threaded on the tube in rearwardly spaced relation to the carrier, the carrier initially abutting the upper portion of the inner leg of the body, and a short, heavy-duty compression spring surrounding the tube in engagement between the carrier and said nut; the carrier sliding rearwardly on the tube in compressing relation to the spring and in response to resistance, to forward movement of the stem, occasioned by clamping of a work piece between the alined work-engaging pads.

6. An improved C-clamp comprising a C-shaped body having an outer leg and an inner leg, a tube secured to the free end of the inner leg and extending rearwardly therefrom, a stem slidably engaged in the tube and projecting from the front end thereof, alined work-engaging pads on the exposed front end of the stem and the outer leg of the body, a hand grip unit mounted in connection with and depending from the tube rearwardly of the body, the hand grip unit including a hand grip and a movable hand lever pivotally associated therewith, the hand lever being movable by one-hand squeezing of the hand grip unit, and means between the hand grip unit and the stem operative to step-by-step advance the stem in the tube upon recurrent manual squeezing of the hand grip unit and resultant movement of the hand lever, and means to releasably hold the stem in each advanced position thereof; the hand grip being formed at its upper end with a box-like carrier comprising a front wall, a rear wall, and side walls, the tube passing through the end walls and extending in the carrier intermediate the side walls, the hand lever being pivoted intermediate its ends on the hand grip below the carrier and including transversely-spaced side plates which upstand above the pivot and lie close to corresponding side walls of the carrier, the tube being formed with a longitudinal topslot in the working zone of the stem-advancing means, the stem-advancing means and stem-holding means being included in a ratchet mechanism having, within the carrier, a spring-urged advancing pawl and a spring-urged holding pawl, respectively, the stem having thereon a row of rearwardly-facing ratchet teeth normally exposed through the slot and to the interior of the carrier, the advancing pawl being transversely pivotally mounted in connection with the side plates of the hand lever and the holding pawl being transversely pivotally mounted in connection with the side walls of the carrier, the pawls extending through the slot and normally engaging ratchet teeth of said row, and the stem being manually rotatable in the tube to release both of said pawls from the ratchet teeth.

7. An improved C-clamp, as in claim 6, including a handle projecting from the stem beyond the front end of the tube; the handle being adapted for manipulation to rotate the stem in the tube whereby to effect said release of the pawls from the ratchet teeth.

8. An improved C-clamp, as in claim 6, in which the carrier is slidable on the tube, a wing nut adjustably threaded on the tube in rearwardly-spaced relation to the carrier, the carrier initially abutting the upper portion of the inner leg of the body, a short, heavy-duty compression spring surrounding the tube in engagement between the carrier and said wing nut; the carrier sliding rearwardly on the tube in compressing relation to the spring and in response to resistance, to forward movement of the stem, occasioned by clamping of a working piece between the alined work-engaging pads.

* * * * *